US005397199A

United States Patent [19]

Frampton et al.

[11] Patent Number: 5,397,199

[45] Date of Patent: Mar. 14, 1995

[54] SCREED ASSEMBLY FOR AN ASPHALT PAVING MACHINE

[75] Inventors: John J. Frampton, Peoria; John A. Grassi, Princeville; Karen R. Raab, Peoria; Richard G. Eaton, Pekin, all of Ill.

[73] Assignee: Caterpillar Paving Products Inc., Minneapolis, Minn.

[21] Appl. No.: 102,909

[22] Filed: Aug. 6, 1993

[51] Int. Cl.[6] ..... E01C 19/22

[52] U.S. Cl. ..... 404/118; 404/95

[58] Field of Search ..... 404/77, 79, 96, 118, 404/95

[56] References Cited

U.S. PATENT DOCUMENTS 3,557,672 1/1971 Shurtz ..... 94/44
5,096,331 3/1992 Raymond ..... 404/118
5,139,362 8/1992 Richter et al. ..... 404/95

FOREIGN PATENT DOCUMENTS 939950 1/1974 Canada ..... 404/118

*Primary Examiner*—Ramon S. Britts
*Assistant Examiner*—James A. Lisehora
*Attorney, Agent, or Firm*—Frank L. Hart

[57] ABSTRACT

A screed assembly has a screed plate that is formed of a material having a thermal conductivity of less than about 25 W/mK, and a thermal barrier material having a thermal conductivity of less than about 0.5 W/mK that substantially covers an upper surface of the screed plate. The low thermal conductance properties of the screed plate obviate the need for auxiliary heating systems to preheat or maintain the screed plate in thermal equilibrium with a paving material.

9 Claims, 1 Drawing Sheet

SCREED ASSEMBLY FOR AN ASPHALT PAVING MACHINE

TECHNICAL FIELD

This invention relates generally to an asphalt paving screed and more particularly to a screed plate having low thermal conductivity.

BACKGROUND ART

Asphalt paving screeds typically require auxiliary heaters, or burners, to apply heat to the material contacting plate of the screed to prevent sticking of asphalt paving material to the screed plate. U.S. Pat. No. 3,557,672, issued Jan. 26, 1971 to Albert L. Shurtz, describes a burner system and baffle arrangement to direct a flow of heat from a plurality of burners to selected surfaces of the screed assembly. An alternative arrangement in which the screed of an asphalt paver is heated by oil maintained in a reservoir that is in heat-transferring contact with the screed plate is described in U.S. Pat. No. 5,096,331 issued Mar. 17, 1992 to Larry Raymond. The burners or other heating arrangements of presently known screed systems typically require hydraulic or fuel systems, controls, and electrical systems to heat the material contacting plates. Such systems are costly to construct and troublesome to maintain.

The present invention is directed to overcoming the problems set forth above. It is desirable to have a screed assembly that does not require any form of auxiliary heating to prevent freezing, or sticking, of the paving material to the screed plate. It is also desirable to have a screed plate that is economical to produce and maintain.

The present invention overcomes the above described problems by providing a material contacting member, or screed plate, that has low heat transfer properties, i.e., low thermal conductance, and limited heat energy storage capacity. As a result of these characteristics, the screed plate embodying the present invention is capable of being heated at a desirable rate and maintained at a temperature sufficient to prevent sticking of the asphalt material to the plate, solely by heat transferred from the paving material. Furthermore, the present invention effectively eliminates the large thermal gradient that, heretofore, was inherently present between the plate and paving material.

DISCLOSURE OF THE INVENTION

In accordance with one aspect of the present invention, a screed assembly for an asphalt paving machine has a frame member and a screed plate attached to a frame member and a thermal barrier material in contact with the screed plate. The screed plate has a material contacting surface, a second surface spaced from the material contacting surface and a thermal conductivity of less than about 25 W/mK. The thermal barrier material substantially covers the second surface of the screed plate and has a thermal conductivity of less than about 0.5 W/mK.

Other features of the screed assembly include a cover plate disposed in contacting relationship with the thermal barrier material, in spaced relationship with the screed plate.

BEST MODE FOR CARRYING OUT THE INVENTION

Figure 1:
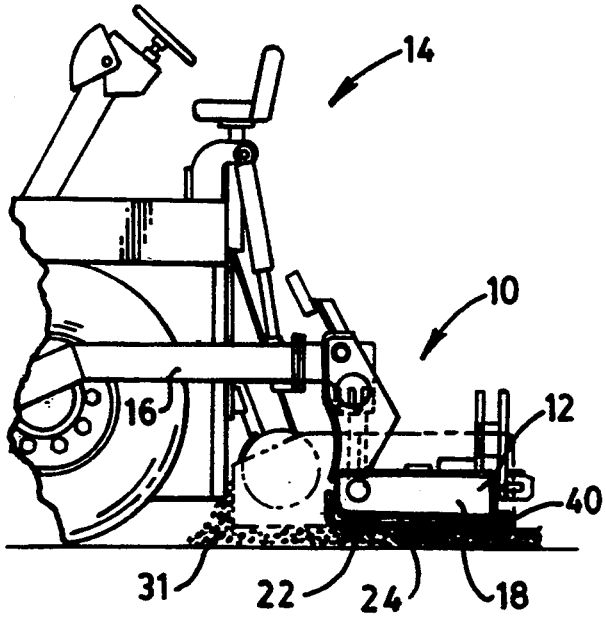
FIG. 1 is a partial side view of an asphalt paver having the screed assembly embodying the present invention attached thereto.
Figure 2:
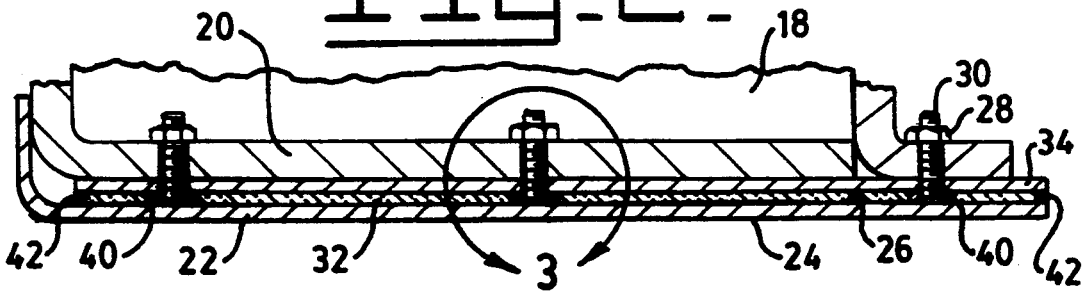
FIG. 2 is an enlarged view of the screed plate portion of the screed assembly embodying the present invention.
Figure 3:
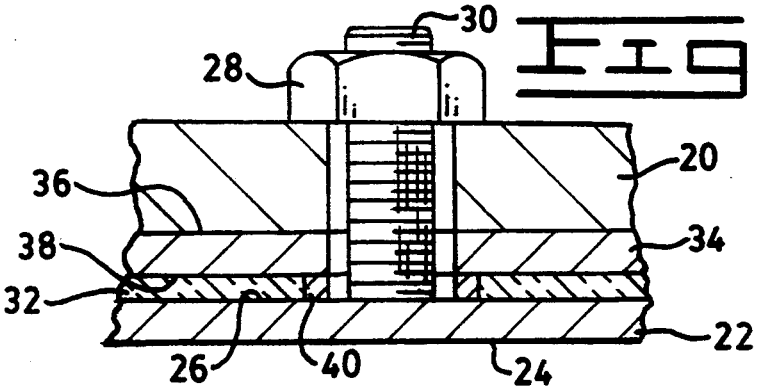
FIG. 3 is yet a further enlarged view of the encircled portion of the screed assembly identified by the numeral 3 in FIG. 2.

In the preferred embodiment of the present invention, a screed assembly 10 includes a frame member 12 that is attachable to an asphalt paver 14 by a pair of conventional tow arms 16. The frame member 12 includes a plurality of vertically disposed wall members 18, each having a horizontally disposed mounting plate 20 attached by a weld joint at a lower edge of the wall members.

The screed assembly 10 also includes a screed plate 22 having a material contacting surface 24 on the bottom side of the plate, and a second surface 26 on the upper side of the plate. The screed plate 22 is removably attached to the frame member 12 by a plurality of nut members 28 threadably engaging a respective stud bolt 30. The stud bolts 30 are welded to the second surface 26 of the screed plate 22.

Heretofore, screed plates have typically been constructed of carbon steel plate having a thickness of from about 12.7 mm ($\frac{1}{2}$ in) to about 19.05 mm ($\frac{3}{4}$ in). Carbon steel has relatively high thermal conductivity (about 47 W/mK) and a hardness of only about Rockwell C21. In carrying out the present invention, it is essential that the screed plate 22 be constructed of a wear-resistant material having low thermal conductivity. In order to be effective, the thermal conductivity of the screed plate should be no greater than about 25 W/mK and preferably less than about 18 W/mK. In the preferred embodiment of the present invention the screed plate 22 is constructed of a heat resistant, martensitic stainless steel having a thickness of only about 6.35 mm ($\frac{1}{4}$ in), a thermal conductivity of 15 W/mK, and a hardness of Rockwell C45. Thus, the screed plate 22 embodying the present invention has significantly lower thermal conductivity, less mass, and much greater wear resistance, i.e., hardness, than presently known screed plates. These properties provide a screed plate that conducts heat away from a heated asphalt material 31 in contact with the plate at a much slower rate and has less heat energy storage capacity due to its lower mass.

Alternate materials that may be suitable for construction of the screed plate 22 embodying the present invention, include other grades of wrought stainless steel, certain wrought iron-base alloys, and structural ceramic materials. Preferably, the material selected for construction of the screed plate 22 has a thermal conductivity of less than about 25 W/mK and a hardness of at least about Rockwell C40.

Preferably, the stud bolts 30 are also constructed of a material having low thermal conductivity characteristics. In the preferred embodiment of the present invention, the stud bolts 30 are constructed of stainless steel having thermal conductance properties similar to that of the screed plate 22.

The screed assembly 10 also includes a thermal barrier material 32 that is in contact with, and substantially covers, the second surface 26 of the screed plate 22. Desirably, the thermal barrier material has a thermal conductivity of less than about 0.5 W/mK, and preferably less than about 0.1 W/mK. As can be easily understood, for a given amount of heat transfer, a lower thermal conductivity permits the use of a correspondingly thinner layer of the thermal barrier material. For example, in the preferred embodiment of the present invention, the thermal barrier material is a moisture resistant, woven fiberglass cloth having a thermal conductivity of about 0.046 W/mK and a thickness of only about 3.2 mm (⅛ in). Other materials suitable for the thermal barrier 32 include stagnant air (which has a thermal conductivity of about 0.026 W/mK), dense or porous plastics, mats of plastic or ceramic fibers, and either dense or porous ceramic or organic materials. The selected thermal insulating material should also have a service temperature of at least about 170° C. to avoid degradation during prolonged use with hot asphalt materials.

Preferably, the screed assembly 10 also includes a cover plate 34 that is disposed in nominal contacting relationship with the thermal barrier material 32. The cover plate not only provides protection for the thermal barrier material but also adds stiffness to the assembly comprising the screed plate 22, the thermal barrier material 32 and the cover plate 34 to compensate for the reduced thickness of the screed plate 22. In the preferred embodiment of the present invention, the cover plate 34 is essentially a flat plate formed of carbon steel having a thermal conductivity of about 47 W/mK and a thickness of about 6.35 mm (¼ in). The cover plate also has an upper planar surface 36 and a lower planar surface 38, with the lower surface 38 being positioned adjacent the thermal barrier material 32.

To avoid undue compression of the thermal barrier material 32, the cover plate 34 is preferably maintained in a spaced relationship with respect to the screed plate 22 by a plurality of spacers 40 interposed the second surface 26 of the screed plate 22 and the lower planar surface 38 of the cover plate. In the preferred embodiment of the present invention, the spacers 40 are in the form of narrow rings disposed about each of the stud bolts 30, have a thickness corresponding to the nominal thickness of the thermal barrier material 32, i.e., about 3.2 mm (⅛ in), and are formed of stainless steel having low thermal conductivity to avoid excessive heat transfer through the spacer members 40.

Although not essential, it is desirable to have a seal member 42 disposed around the periphery of the thermal barrier material 32 to prevent infiltration of moisture and foreign matter. The seal member 42 is preferably a compression-type seal formed of a metallic, elastomeric, or similar material. Preferably, the seal member 42 also has relatively low thermal conductivity. The seal member is typically positioned adjacent the peripheral edge of the thermal barrier material 32, and between the second surface 26 of the screed plate 22 and the lower planar surface 38 of the cover plate 34. If the stagnant air is selected as the thermal barrier material, it is necessary for the seal member 42 to extend completely around the area to be sealed between the screed plate 22 and the cover plate 34. However, in some screed arrangements, portions of the sandwich-like assembly comprising the screed plate 22, the thermal barrier material 32 and the cover plate 34 may be protected, or shielded, by components of the screed assembly 10. In such arrangements, if a thermal barrier material other than stagnant air is selected, it may not be necessary for the seal member 42 to extend completely around the periphery of the thermal barrier material 32.

A test of the screed assembly 10 constructed as described above with respect to the preferred embodiment of the invention, i.e., with a stainless steel screed plate 22 having a thickness of about 6.35 mm (¼ in) and thermal conductivity of about 15 W/mK, and a woven fiberglass thermal barrier material 32 having a thickness of about 3.2 mm (⅛ in) and thermal conductivity of about 0.046 W/mK sandwiched between the screed and cover plates, was conducted using a hot mix asphalt material. The asphalt mix was deposited in the hopper of the paver 14, conveyed to the rear, and distributed laterally by the augers mounted at the rear of the paver, ahead of the screed assembly 10. The paver was then moved forward a few feet to move the screed assembly 10 over the distributed hot asphalt mix, and bring the material contacting surface 24 of the screed plate 22 into contact with the asphalt mix. Forward movement of the paver was then stopped for about 30 seconds to allow thermal equilibration of the screed plate 22 with the asphalt mix. After this short time period, the paver resumed forward movement and normal operation, during which time a continuous mat of asphalt material was deposited behind the paver.

During this test, there was no evidence of sticking, or freezing, of the asphalt material to the material contacting surface 24 of the screed plate 22. The surface of the mat formed by the screed plate 24 was smooth, without any significant surface defects, or other evidence, indicating that material was being picked up or dragged by the screed plate 22. Furthermore, after the test, the screed assembly 10 was raised and the material contacting surface 24 of the screed plate 22 examined for material deposits. The surface 24 was found to be relatively clean, with no significant deposits of asphalt material attached to the surface.

As evidenced by this test, heating of the screed plate 22 with burners or other type of auxiliary heating apparatus was not required prior to commencement of paving operations. This is a significant discovery that will now make possible the construction of asphalt paving screeds without the cumbersome and expensive auxiliary heating apparatus, and the attendant controls for such heaters, that have heretofore been required.

INDUSTRIAL APPLICABILITY

The screed assembly 10 embodying the present invention is particularly useful for distributing, smoothing, and at least partially compacting, both hot and cold asphalt mixtures. The low heat conductivity and heat capacity characteristics of the screed plate 22 make it now possible, when required, to quickly bring the screed plate 22 into thermal equilibrium with the asphalt mix and effectively diminish, i.e., for all practical purposes eliminate, the thermal gradient, or temperature difference, that has heretofore been present between the screed plate/paving material interface.

The screed assembly 10 embodying the present invention does not require auxiliary heating apparatus to preheat, or maintain a flow of heat energy, to the screed plate, and therefore is less costly to build, maintain, and control.

Other aspects, objects and advantages of this invention can be obtained from a study of the drawings, the disclosure, and the appended claims.

What is claimed is:

1. A screed assembly for an asphalt paving machine, comprising:

a frame member attachable to said asphalt paving machine;

a screed plate attached to said frame member and having a material contacting surface and a second surface spaced from said material contacting surface, and formed of a material having a thermal conductivity of less than about 25 W/mK; and a thermal barrier material disposed in contacting relationship with said second surface of the screed plate and substantially covering said second surface and having a thermal conductivity of less than about 0.5 W/mK.

2. A screed assembly, as set forth in claim 1, wherein said assembly includes a cover plate disposed in contacting relationship with said thermal barrier material and in spaced relationship with said screed plate.

3. A screed assembly, as set forth in claim 2, wherein said cover plate is an essentially flat plate having upper and lower planar surfaces, said lower planar surface being adjacent said thermal barrier material, and said screed assembly includes a seal member interposed at least a portion of the second surface of said screed plate and the lower planar surface of said cover plate.

4. A screed assembly, as set forth in claim 1, wherein said screed plate is formed of a wear resistant material having a hardness greater than Rockwell C35.

5. A screed assembly, as set forth in claim 1, wherein said screed plate is formed of stainless steel having a thermal conductivity less than 18 W/mK, a hardness greater than Rockwell C40, and a thickness of about 6.4 mm.

6. A screed assembly, as set forth in claim 1, wherein said thermal barrier material has a thermal conductivity of less than 0.1 W/mK.

7. A screed assembly, as set forth in claim 1, wherein said thermal barrier material is woven fiberglass cloth having a thickness of about 3.2 mm.

8. A screed assembly, as set forth in claim 3, wherein said thermal barrier material is a layer of stagnant air having a thickness of about 3.2 mm.

9. A screed assembly, as set forth in claim 1, wherein said assembly includes a plurality of stud members having a first end attached to said second surface of the screed plate and a second end connected to said frame member, and being constructed of a material having a thermal conductivity of less than about 25 W/mK.

* * * * *